US009194031B2

(12) United States Patent
Ichino et al.

(10) Patent No.: US 9,194,031 B2
(45) Date of Patent: Nov. 24, 2015

(54) TOOL FOR PIERCING MILL

(71) Applicant: JFE STEEL CORPORATION, Chiyoda-ku, Tokyo (JP)

(72) Inventors: Kenji Ichino, Handa (JP); Seiji Ozaki, Handa (JP); Tetsuo Mochida, Handa (JP)

(73) Assignee: JFE STEEL CORPORATION, Tokyo (JP)

( * ) Notice: Subject to any disclaimer, the term of this patent is extended or adjusted under 35 U.S.C. 154(b) by 11 days.

(21) Appl. No.: 14/361,679

(22) PCT Filed: Nov. 28, 2012

(86) PCT No.: PCT/JP2012/007617

§ 371 (c)(1),
(2) Date: May 29, 2014

(87) PCT Pub. No.: WO2013/080528

PCT Pub. Date: Jun. 6, 2013

(65) Prior Publication Data

US 2015/0176107 A1 Jun. 25, 2015

(30) Foreign Application Priority Data

Nov. 30, 2011 (JP) ..... 2011-261307

(51) Int. Cl.

| | |
|---|---|
| ***C22C 38/44*** | (2006.01) |
| ***C22C 38/48*** | (2006.01) |
| ***C22C 38/52*** | (2006.01) |
| ***C21D 9/22*** | (2006.01) |

(Continued)

(52) U.S. Cl.

CPC ..... *C22C 38/52* (2013.01); *B21B 25/00* (2013.01); *C21D 1/84* (2013.01); *C21D 9/00* (2013.01); *C21D 9/22* (2013.01); *C22C 38/00* (2013.01); *C22C 38/002* (2013.01); *C22C 38/02* (2013.01); *C22C 38/04* (2013.01); *C22C 38/06* (2013.01); *C22C 38/44* (2013.01); *C22C 38/48* (2013.01); *C22C 38/60* (2013.01); *B21B 25/04* (2013.01); *C21D 2211/005* (2013.01)

(58) Field of Classification Search

None

See application file for complete search history.

(56) References Cited

FOREIGN PATENT DOCUMENTS

| | | |
|---|---|---|
| JP | 59-9154 A | 1/1984 |
| JP | 63-69948 A | 3/1988 |

(Continued)

OTHER PUBLICATIONS

International Search Report (ISR) dated Feb. 26, 2013 (and English translation thereof) in International Application No. PCT/JP2012/007617.

*Primary Examiner* — Deborah Yee

(74) *Attorney, Agent, or Firm* — Holtz, Holtz, Goodman & Chick PC

(57) ABSTRACT

A tool for a piercing mill, the tool comprising a scale layer in a surface layer of a substrate steel, wherein the scale layer includes a net structure scale layer that is formed on a substrate steel side, has a thickness of 10 to 200 μm in a depth direction, and is complicatedly intertwined with a metal; and wherein a microstructure on the substrate steel side in a range of at least 300 μm in the depth direction from an interface between the net structure scale layer and the substrate steel contains a ferrite phase at an area fraction of 50% or more, the ferrite phase containing 400/mm$^2$ or more ferrite grains having a maximum length of 1 to 60 μm.

2 Claims, 3 Drawing Sheets

(51) Int. Cl.

| | |
|---|---|
| ***B21B 25/00*** | (2006.01) |
| ***C21D 9/00*** | (2006.01) |
| ***C22C 38/00*** | (2006.01) |
| ***C22C 38/60*** | (2006.01) |
| ***C22C 38/02*** | (2006.01) |
| ***C22C 38/04*** | (2006.01) |
| ***C22C 38/06*** | (2006.01) |
| ***C21D 1/84*** | (2006.01) |
| *B21B 25/04* | (2006.01) |

(56) References Cited

FOREIGN PATENT DOCUMENTS

| | | | |
|---|---|---|---|
| JP | 08-90015 | A | 4/1996 |
| JP | 08-193241 | A | 7/1996 |
| JP | 10-5821 | A | 1/1998 |
| JP | 11-179407 | A | 7/1999 |
| JP | 2000-190008 | A | 7/2000 |
| JP | 2003-103301 | A | 4/2003 |
| JP | 2003-129184 | A | 5/2003 |

TOOL FOR PIERCING MILL

TECHNICAL FIELD

The present invention relates to the production of a seamless pipe and particularly to the improvement in wear resistance of a tool for a piercing mill such as a plug used for piercing.

BACKGROUND ART

A Mannesmann piercing method has been widely known as a method for producing a seamless pipe. In this method, first, a material to be pierced (round billet) that is heated to a certain temperature is subjected to a piercing process with a piercing mill to obtain a hollow shell. Subsequently, the wall thickness is decreased by using an elongating mill such as an elongator, a plug mill, or a mandrel mill. Furthermore, reheating is performed when necessary and then the outer diameter is mainly decreased with a stretch reducing mill or a sizing mill to obtain a seamless pipe having a predetermined size.

Examples of a known piercing mill include a Mannesmann piercer in which a pair of inclined rolls, a piercing plug, and two guide shoes are combined; a three rolls piercer in which three inclined rolls and a piercing plug are combined; and a press roll piercer in which two grooved rolls and a piercing plug are combined. In the piercing process that uses such a piercing mill, a tool (plug) for a piercing mill is exposed to a high-temperature and high-load environment for a long time and wear, erosion, and the like are easily caused. Therefore, as described in Patent Literatures 1, 2, 3, 4, and 5, the wear of a tool for a piercing mill has been prevented by forming an oxide scale having a thickness of several tens of micrometers to several hundred micrometers on a surface of the tool through an oxide scale-forming heat treatment at high temperature.

In recent years, however, there has been an increasing demand for high-alloy steel seamless pipes made of, for example, 13Cr steel and stainless steel that have high hot deformation resistance and a surface on which an oxide scale is not easily formed. The technologies described in Patent Literatures 1, 2, 3, 4, and 5 pose a problem in that, when such a high-alloy steel is pierced, a tool is quickly worn.

In view of the foregoing problem, the inventors of the present invention have proposed a tool for a piercing mill with excellent wear resistance in Patent Literature 6. In the technology described in Patent Literature 6, the tool has a composition containing C: 0.05% to 0.5%, Si: 0.1% to 1.5%, Mn: 0.1% to 0.5%, Cr: 0.1% to 1.0%, Mo: 0.5% to 3.0%, W: 0.5% to 3.0%, and Nb: 0.1% to 1.5% and further containing Co: 0.1% to 3.0% and Ni: 0.5% to 2.5% such that (Ni+Co) satisfies less than 4% and more than 1%. The tool has a scale layer in the surface layer thereof and the scale layer includes a net structure scale layer complicatedly intertwined with a metal on the substrate steel side. Furthermore, the tool for a piercing mill includes a microstructure containing a ferrite phase at an area fraction of 50% or more, the microstructure being formed on the substrate steel side from the interface of the scale layer. This can increase the lifetime of the tool and improves the productivity of high-alloy steel seamless pipes with a piercing mill.

CITATION LIST

Patent Literature

PTL 1: Japanese Unexamined Patent Application Publication No. 59-9154

PTL 2: Japanese Unexamined Patent Application Publication No. 63-69948

PTL 3: Japanese Unexamined Patent Application Publication No. 08-193241

PTL 4: Japanese Unexamined Patent Application Publication No. 10-5821

PTL 5: Japanese Unexamined Patent Application Publication No. 11-179407

PTL 6: Japanese Unexamined Patent Application Publication No. 2003-129184

SUMMARY OF INVENTION

Technical Problem

In recent years, the environment in which seamless pipes are used has become increasingly severe. To withstand such an environment that has become increasingly severe, the seamless pipes used are required to be of high quality and a higher-alloy steel tends to be used. This increases the hot deformation resistance of a material to be pierced and the load on the tool for a piercing mill during piercing tends to become increasingly high. On the other hand, a reduction in production cost has been strongly demanded and a further increase in the lifetime of a tool for a piercing mill has been desired. Therefore, even the technology described in Patent Literature 6 cannot sufficiently satisfy the recent demands for a tool for a piercing mill, and consequently a further increase in the lifetime of a tool for a piercing mill has been more strongly demanded. In particular, since an excessive amount of oxide scale is often formed in order to increase the lifetime of a tool for a piercing mill, partial peeling of an oxide scale, dropping off of an oxide scale, and the like frequently occur. This causes surface deterioration of a plug and a decrease in the tool diameter, resulting in, for example, the formation of defects on a pipe inner surface and a decrease in the dimensional accuracy of a pipe. Consequently, the lifetime of a tool is decreased. Therefore, there has been a strong demand for improvement in wear resistance, such as a further increase in the lifetime of a tool.

It is an object of the present invention to provide a tool for a piercing mill that overcomes the problems of the related art and has excellent wear resistance.

Solution to Problem

To achieve the above object, the inventors of the present invention have thoroughly studied on the influences of various factors on the lifetime of a tool. Consequently, the inventors have found that there is a tool for a piercing mill that has a significantly long lifetime in some rare cases. As a result of detailed research on the microstructure of the tool having a long lifetime, the inventors have found that a microstructure on the substrate steel side directly below the interface between the substrate steel and a net structure scale layer which is formed in a surface layer of the substrate steel and in which a metal and a scale are complicatedly intertwined with each other contains a ferrite dominant layer containing a large number of fine ferrite grains.

The tool for a piercing mill that has such a microstructure has a fine net structure scale. The inventors of the present invention have considered that the fine net structure scale improves the resistance of peeling a scale layer and significantly increases the lifetime of the tool.

The present invention has been completed on the basis of the above findings with further studies. That is, the gist of the present invention is as follows.

(1) A tool for a piercing mill with excellent wear resistance includes a scale layer in a surface layer of a substrate steel, wherein the substrate steel has a composition containing, on a mass % basis, C: 0.05% to 0.5%, Si: 0.1% to 1.5%, Mn: 0.1% to 1.5%, Cr: 0.1% to 1.5%, Mo: 0.6% to 3.5%, W: 0.5% to 3.5%, and Nb: 0.1% to 1.0% and further containing Co: 0.5% to 3.5% and Ni: 0.5% to 4.0% so as to satisfy formula (1) below, with the balance being Fe and incidental impurities.

$$1.0<Ni+Co<4.0 \quad (1)$$

(where Ni represents a content (mass %) of nickel and Co represents a content (mass %) of cobalt)

The scale layer includes a net structure scale layer that is formed on a substrate steel side, has a thickness of 10 to 200 μm in a depth direction, and is complicatedly intertwined with a metal. A microstructure on the substrate steel side in a range of at least 300 μm in the depth direction from an interface between the net structure scale layer and the substrate steel contains a ferrite phase at an area fraction of 50% or more, the ferrite phase containing 400/mm$^2$ or more of ferrite grains having a maximum length of 1 to 60 μm.

(2) In (1), the composition further contains Al: 0.05% or less.

Advantageous Effects of Invention

According to the present invention, a significant increase in the lifetime of a tool for a piercing mill can be achieved and the cost for tools can be reduced. Furthermore, the productivity of high-alloy steel seamless pipes can be improved and the production cost of high-alloy steel seamless pipes can be reduced. Accordingly, significant industrial advantages are achieved.

DESCRIPTION OF EMBODIMENTS

Figure 1:
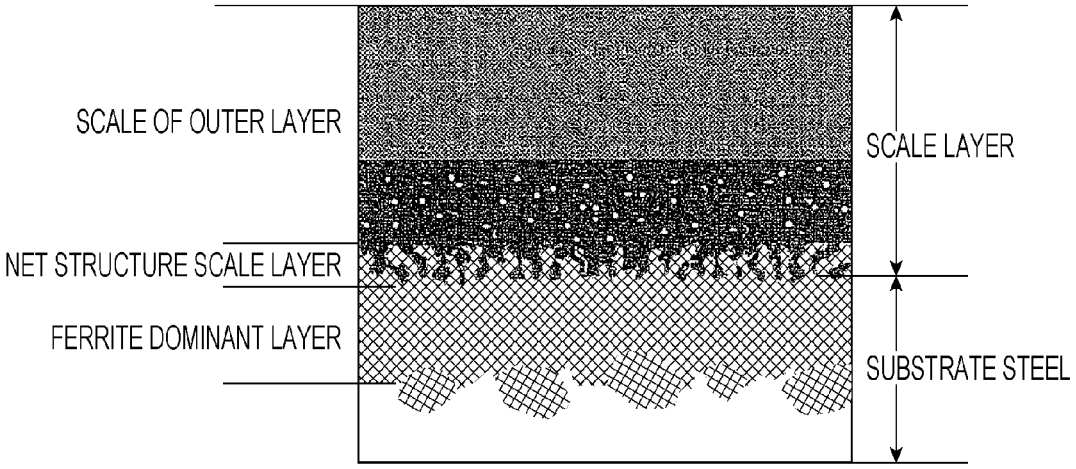
FIG. 1 is an explanatory view schematically showing a cross-sectional microstructure near an interface between a scale layer and a metal.

A tool for a piercing mill according to the present invention is a tool for a piercing mill that includes a scale layer in a surface layer of a substrate steel having a particular composition. First, the reasons for the limitations on the composition of a substrate steel will be described. Hereafter, mass % is simply expressed as % unless otherwise specified.

C: 0.05% to 0.5%

C is an element that dissolves into a substrate steel and thus increases the strength of the substrate steel and that suppresses the reduction in the high-temperature strength of the substrate steel by forming a carbide. To achieve such effects, 0.05% or more of C needs to be contained. On the other hand, at a C content exceeding 0.5%, it is difficult to provide, in the substrate steel, a microstructure in which a ferrite phase is precipitated. Furthermore, the melting point decreases and the high-temperature strength decreases, which shortens the plug lifetime. Accordingly, the C content is limited to the range of 0.05% to 0.5%. The C content is preferably 0.1% to 0.4%.

Si: 0.1% to 0.5%

Si increases the strength of the substrate steel through solution hardening and also increases the carbon activity of the substrate steel, whereby a decarburized layer is easily formed and a microstructure in which a ferrite phase is precipitated is easily formed in the substrate steel. To achieve such effects, 0.1% or more of Si needs to be contained. On the other hand, at a Si content exceeding 1.5%, a dense oxide is formed on a surface of the substrate steel, which inhibits the formation of a net structure scale layer. Accordingly, the Si content is limited to the range of 0.1% to 1.5%. The Si content is preferably 0.2% to 1.0%.

Mn: 0.1% to 1.5%

Mn dissolves into a substrate steel and thus increases the strength of the substrate steel; and also bonds to S that mixes as an impurity and that adversely affects the quality of a material and forms MnS, thereby suppressing the adverse effects of S. To achieve such effects, 0.1% or more of Mn needs to be contained. On the other hand, at a Mn content exceeding 1.5%, the growth of a net structure scale is inhibited. Accordingly, the Mn content is limited to the range of 0.1% to 1.5%. The Mn content is preferably 0.2% to 1.0%.

Cr: 0.1% to 1.5%

Cr dissolves into a substrate steel and thus increases the strength of the substrate steel; and also forms a carbide and increases the high-temperature strength, thereby improving the heat resistance of a plug. Cr is also an element that oxidizes more easily than Fe and thus facilitates selective oxidization. To achieve such effects, 0.1% or more of Cr needs to, be contained. On the other hand, at a Cr content exceeding 1.5%, a dense Cr oxide is formed, which inhibits the growth of a net structure scale layer. In addition, the carbon activity of the substrate steel is decreased and the growth of a decarburized layer is inhibited, which suppresses the formation of a microstructure in which a ferrite phase is precipitated. Accordingly, the Cr content is limited to the range of 0.1% to 1.5%. The Cr content is preferably 0.2% to 1.0%.

Mo: 0.6% to 3.5%

No is an important element that is subjected to microsegregation into a ferrite phase and thus causes selective oxidization, thereby facilitating the formation of a net structure scale layer. A No oxide starts to sublimate at a temperature of 650° C. or higher and thus forms a pathway of $H_2$, $H_2O$, CO, and $CO_2$ in an oxidization reaction, thereby facilitating selective oxidization and the formation of a decarburized layer. Such effects are achieved when 0.6% or more of No is contained. On the other hand, at a Mo content exceeding 3.5%, microsegregation occurs coarsely, which suppresses the growth of a net structure scale layer and degrades the adhesiveness of the scale layer. In addition, the melting point decreases, which facilitates the erosion of a plug and degrades the heat resistance. Accordingly, the Mo content is limited to the range of 0.6% to 3.5%. The Mo content is preferably 0.8% to 2.0%.

W: 0.5% to 3.5%

Similarly to Mo, W is subjected to microsegregation into a ferrite phase and thus facilitates selective oxidization. W also promotes the formation of negatively segregated portions of Ni and Co and facilitates the growth of a net structure scale layer. In addition, W increases the strength of the substrate steel through solution hardening and forms a carbide, thereby increasing the high-temperature strength of a plug. Such effects are achieved when 0.5% or more of W is contained. However, at a W content exceeding 3.5%, microsegregation occurs coarsely, which inhibits the growth of a net structure scale layer. Furthermore, the melting point of the scale decreases, which facilitates the erosion of the plug. Accordingly, the W content is limited to the range of 0.5% to 3.5%. The W content is preferably 1.0% to 3.0%.

Nb: 0.1% to 1.0%

Nb is a carbide-forming element that bonds to C and forms a carbide; and decreases the amount of free C in the substrate steel and facilitates the formation of a ferrite phase, thereby contributing to the formation of a ferrite dominant layer. A Nb carbide is easily formed in a grain boundary and also very easily oxidized. Therefore, the Nb carbide serves as an entry pathway of oxygen and facilitates the growth of a scale layer. Furthermore, Nb has a high affinity for No and thus facilitates microsegregation of Mo. To achieve such effects, 0.1% or more of Nb needs to be contained. On the other hand, at a Nb content exceeding 1.0%, the carbide becomes coarse, which easily causes crack damage on a plug. Accordingly, the Nb content is limited to the range of 0.1% to 1.0%. The Nb content is preferably 0.1% to 0.8%.

Co: 0.5% to 3.5%

Co dissolves into a substrate steel and thus increases the high-temperature strength of the substrate steel; and facilitates the selective oxidization of Fe and Mo because Co is less oxidized than Fe and Mo, thereby facilitating the formation of a net structure scale. In the growth process of the net structure scale, Co is concentrated in a metal near the selectively oxidized portion. In a metal region in which Co is concentrated, oxidization is suppressed and thus a microstructure in which the metal and the scale are complicatedly intertwined is easily formed. Since the metal region in which Co is concentrated has high expansibility, the affinity between the metal and the net structure scale is improved and thus the peeling of the scale can be prevented. To achieve such effects, 0.5% or more of Co needs to be contained. On the other hand, at a Co content exceeding 3.5%, Co is concentrated linearly at the interface between the substrate steel and the scale layer and the selective oxidization of Mo and Fe is suppressed, which makes it difficult to grow the net structure scale layer. Accordingly, the Co content is limited to the range of 0.5% to 3.5%. The Co content is preferably 0.5% to 3.0%.

Ni: 0.5% to 4.0%

Ni dissolves into a substrate steel and thus increases the strength and toughness of the substrate steel; and facilitates the selective oxidization of Fe and Mo because Ni is less oxidized than Fe and Mo, thereby facilitating the formation of a net structure scale. In the growth process of the net structure scale, Ni is concentrated in a metal near the selectively oxidized portion. In a metal region in which Ni is concentrated, oxidization is suppressed and thus a microstructure in which the metal and the scale are complicatedly intertwined is easily formed. Since the metal region in which Ni is concentrated has high expansibility, the affinity between the metal and the net structure scale is improved and thus the peeling of the scale can be prevented. To achieve such effects, 0.5% or more of Ni needs to be contained. On the other hand, at a Ni content exceeding 4.0%, Ni is concentrated linearly at the interface between the substrate steel and the scale layer and the selective oxidization of Mo and Fe is suppressed, which makes it difficult to grow the net structure scale layer. Accordingly, the Ni content is limited to the range of 0.5% to 4.0%. The Ni content is preferably 1.0% to 3.0%.

The contents of Ni and Co are adjusted so as to be within the above ranges and satisfy the following formula (1).

$$1.0<Ni+Co<4.0 \quad (1)$$

(where Ni represents a content (mass %) of nickel and Co represents a content (mass %) of cobalt)

If (Ni+Co), which is the total of the contents of Ni and Co, is 1.0 or less, the formation of the net structure scale layer is insufficient. If (Ni+Co) is 4.0 or more, excessive amounts of Ni and Co are concentrated at the interface between the substrate steel and the scale layer and the selective oxidization of Fe and Mo is suppressed, which makes it difficult to form the net structure scale layer. Accordingly, (Ni+Co) is limited to more than 1.0 and less than 4.0.

The above-described components are fundamental components. In addition to the fundamental components, Al: 0.05% or less may optionally be contained as a selective element.

Al: 0.05% or less

Al serves as a deoxidizer and may optionally be contained. Such an effect is significantly achieved when 0.005% or more of Al is contained. On the other hand, at an Al content exceeding 0.05%, the castability degrades and defects such as pinholes and shrinkage cavities are easily generated. Furthermore, at an excessive Al content exceeding 0.05%, a dense $Al_2O_3$ film is formed on the surface during a heat treatment, which inhibits the formation of the net structure scale layer. Accordingly, when Al is contained, the Al content is preferably limited to 0.05% or less.

Instead of Al, REM: 0.05% or less and Ca: 0.01% or less may be contained as a deoxidizer.

The balance other than the above-described components is Fe and incidental impurities. Permissible incidental impurities are P: 0.05% or less, S: 0.03% or less, N: 0.06% or less, Ti: 0.015% or less, Zr: 0.03% or less, V: 0.6% or less, Pb: 0.05% or less, Sn: 0.05% or less, Zn: 0.05% or less, and Cu: 0.2% or less.

A microstructure of the tool for a piercing mill according to the present invention will now be described.

As shown in FIG. 1, the tool for a piercing mill according to the present invention includes a scale layer in a surface layer of the substrate steel having the above-described composition. The scale layer includes a net structure scale layer that is formed on the substrate steel side and complicatedly intertwined with a metal. The net structure scale layer is a scale layer that is complicatedly intertwined with a metal of the substrate steel. In a state in which a metal and the scale layer are complicatedly intertwined with each other, the wear of the scale layer is considerably suppressed compared with a scale layer alone. The presence of the net structure scale layer can prevent the seizing of a material to be pierced onto a plug through the lubrication ability of the scale layer.

In the tool for a piercing mill according to the present invention, the net structure scale layer has a thickness of 10 to 200 μm in the depth direction. If the thickness of the net structure scale layer is less than 10 μm, the tool is quickly worn away due to the friction with a material to be pierced and the net structure scale layer disappears. Consequently, the plug is damaged and the plug lifetime decreases. If the thickness is more than 200 μm, the adhesiveness of the net structure scale layer degrades, which facilitates the peeling of the net structure scale layer. Consequently, the plug is damaged and the plug lifetime decreases. Furthermore, formation of an excessively thick scale layer causes surface deterioration and a significant decrease in the plug diameter due to scale off, which generates defects in a pipe inner surface and decreases the dimensional accuracy of a pipe. Accordingly, the thickness of the net structure scale layer in the depth direction is limited to the range of 10 to 200 μm.

In the tool for a piercing mill according to the present invention, as shown in FIG. 1, a microstructure on the substrate steel side in a range of at least 300 μm in the depth direction from the interface between the net structure scale layer and the substrate steel contains a ferrite phase at an area fraction of 50% or more, the ferrite phase containing 400/$mm^2$ or more of ferrite grains having a maximum length of 1 to 60 μm. When the microstructure on the substrate steel side in a range of at least 300 μm in the depth direction from the interface between the net structure scale layer and the substrate steel contains a ferrite phase at an area fraction of 50% or more, microsegregation of Mo readily occurs and the region is selectively oxidized, which makes it easy to form a net structure scale layer. If the area fraction of the ferrite phase is less than 50%, it is difficult to form a net structure scale layer.

When the microstructure on the substrate steel side in a range of at least 300 μm in the depth direction from the interface is a ferrite dominant layer, Ni, Co, and the like are further concentrated in a metal near the selectively oxidized region through an oxidation heat treatment performed later and thus the adhesiveness of the net structure scale layer is further improved. When the microstructure on the substrate steel side in a range of at least 300 μm in the depth direction from the interface with the net structure scale layer is a ferrite dominant layer containing a ferrite phase at an area fraction of 50% or more, the peeling resistance and wear resistance of the scale are improved. If the ferrite dominant layer has a thickness of less than 300 μm in the depth direction from the interface with the net structure scale layer, desired peeling resistance and wear resistance of scale cannot be achieved.

In the present invention, the metal on the substrate steel side in a range of at least 300 μm in the depth direction from the interface with the net structure scale layer is a ferrite dominant layer as described above. Furthermore, the ferrite phase contains 400/mm$^2$ or more of fine ferrite grains having a maximum length of 1 to 60 μm. Thus, a finer net structure scale layer is formed and the plug lifetime significantly increases. If the ferrite grains are coarse ferrite grains having a maximum length of more than 60 μm, the finer net structure scale layer is not sufficiently formed and the significant increase in the plug lifetime is not achieved. If the maximum length is less than 1 μm, an effect of increasing the plug lifetime is small even when the number of ferrite grains increases.

If the number of fine ferrite grains is less than 400/mm$^2$, the fine net structure scale layer is not sufficiently formed and a significant increase in the plug lifetime is not achieved. Thus, the microstructure on the substrate steel side in a range of at least 300 μm in the depth direction from the interface between the net structure scale layer and the metal is a ferrite dominant layer. Furthermore, the ferrite phase is limited to a ferrite phase containing 400/mm$^2$ or more of fine ferrite grains having a maximum length of 1 to less than 60 μm.

Herein, the "maximum length" of ferrite grains is defined to be as follows. The maximum of lengths of each ferrite grain measured by observing a cross section that is perpendicular to the mean interface of a net structure scale layer is defined as the maximum length of the grain.

A preferred method for producing the tool for a piercing mill according to the present invention will now be described. Preferably, a molten steel having the above-described composition is melted by a typical method that uses an electric furnace, a high-frequency furnace, or the like, cast by a publicly known method such as a vacuum casting method, a green sand casting method, or a shell molding method to obtain a cast billet, and, then subjected to cutting and the like to obtain a substrate steel (tool) with a desired shape. Note that a steel billet may be subjected to cutting and the like to obtain a substrate steel (tool) with a desired shape.

The obtained substrate steel (tool) is then subjected to a heat treatment (scale-forming heat treatment) to form a scale layer in a surface layer of the substrate steel. The heat treatment may be performed in a typical furnace such as a gas burner furnace or an electric furnace. The atmosphere of the heat treatment may be an air atmosphere and need not be adjusted.

Figure 2:
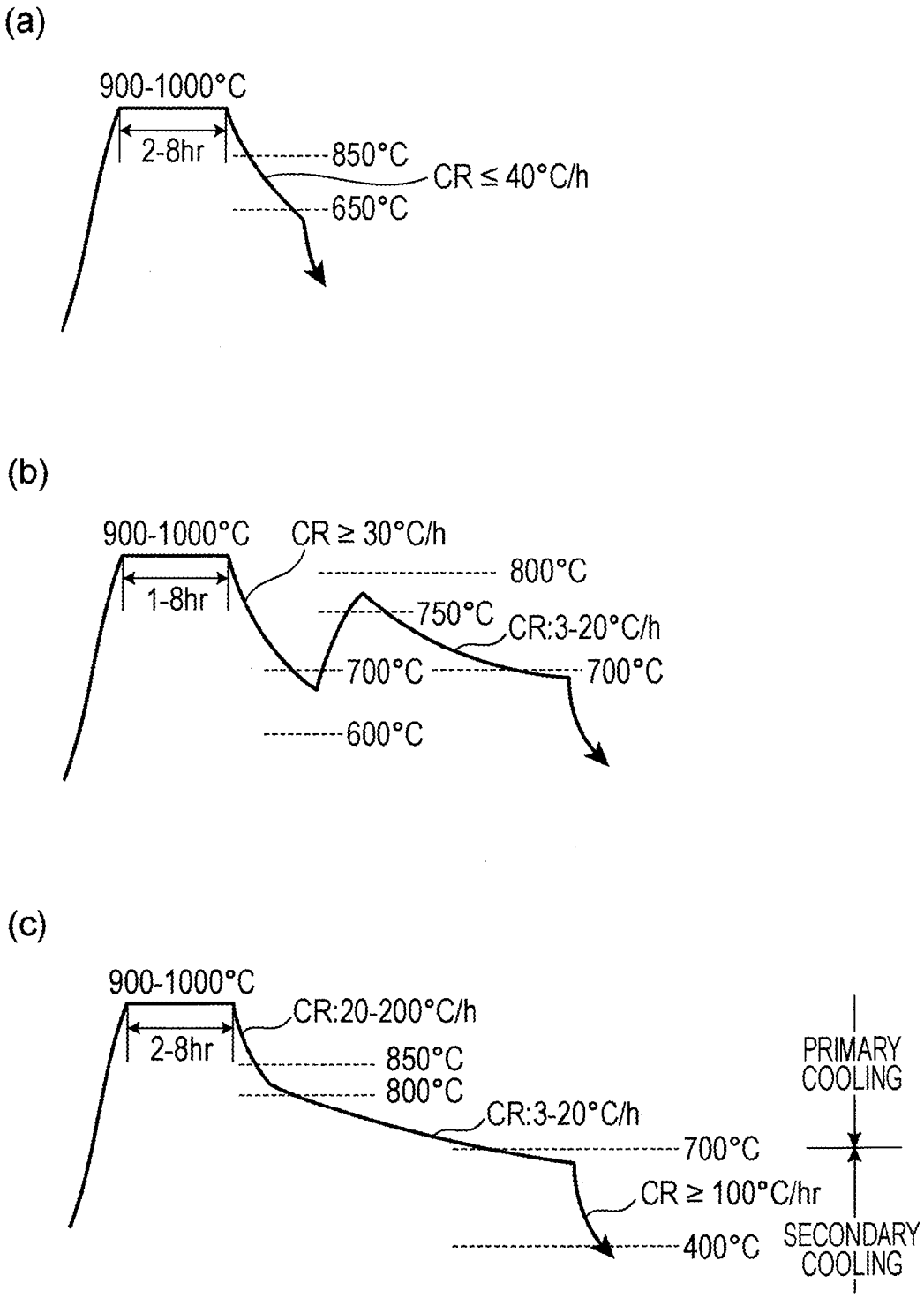
FIGS. 2(*a*) to 2(*c*) are explanatory views schematically showing heat treatment patterns applied in the present invention.

A two-stage heat treatment including a first-stage heat treatment and a second-stage heat treatment is employed as the heat treatment. The first-stage heat treatment is preferably a heat treatment in which the substrate steel is heated and held at a temperature of 900° C. to 1000° C. and then cooled (slowly cooled) at an average cooling rate of 40° C./h or less at least in a temperature range of 850° C. to 650° C. FIG. 2(*a*) schematically shows a first-stage heat cycle pattern.

As a result of the first-stage heat treatment, a scale layer is formed in the surface layer and a microstructure in which ferrite is precipitated is formed in the substrate steel. Furthermore, alloy elements such as Mo and W dissolved in a matrix diffuse in accordance with the temperature and the cooling rate. Consequently, such alloy elements precipitate in the form of a carbide or are concentrated near a grain boundary, resulting in microsegregation of the alloy elements in the matrix. The presence of the microsegregation causes uneven oxidization (selective oxidization) of Fe, Mo, and the like in a heat treatment performed later. Thus, a net structure scale layer having an interface that is complicatedly intertwined with a metal is grown.

If the heating temperature is lower than 900° C., the dissolution of the alloy elements is not facilitated and a desired microsegregation distribution of the alloy elements is not achieved. If the heating temperature is higher than 1000° C., a scale layer is excessively formed in an outer layer, which inhibits the formation of a scale layer having excellent adhesiveness. The heating temperature is preferably held for 2 to 8 hours. If the holding time is less than 2 hours, the alloy elements are not sufficiently dissolved. If the holding time is more than 8 hours, which are excessively long, the productivity is decreased. Furthermore, the amount of scale formed increases, which decreases the dimensional accuracy of the plug. If the average cooling rate in the temperature range of at least 850° C. to 650° C. is more than 40° C./h, which is an excessively high cooling rate, the alloy segregation that is essential for the growth of the net structure scale layer is suppressed.

The second-stage heat treatment is preferably a heat treatment in which the substrate steel is heated and held at a heating temperature of 900° C. to 1000° C., then cooled to a temperature of 600° C. to 700° C. once at an average cooling rate of 30° C./h or more, then recuperated to a temperature of 750° C. or higher and 800° C. or lower, cooled (slowly cooled) to a temperature of 700° C. or lower at a cooling rate of 3 to 20° C./h, and then naturally cooled. FIG. 2(*b*) schematically shows a second-stage heat cycle pattern.

If the heating temperature in the second-stage heat treatment is lower than 900° C., the diffusion and aggregation of alloy elements are not facilitated and thus the formation of a desired net structure scale layer and the formation of a desired metal microstructure (fine ferrite phase) are not achieved. If the heating temperature is higher than 1000° C., a scale layer is excessively formed in an outer layer, which inhibits the formation of a scale layer having excellent adhesiveness. The heating temperature is preferably held for 1 to 8 hours. If the holding time is less than 1 hour, the growth of scale is suppressed and the alloy elements are not sufficiently dissolved. If the holding time is more than 8 hours, which are excessively long, the productivity is decreased. Furthermore, the amount of scale formed increases, which decreases the dimensional accuracy of the plug.

After the heating and holding, if the cooling rate in a temperature range of 600° C. to 700° C. is less than 30° C./h, the formation and growth of ferrite are facilitated, and consequently a ferrite dominant layer in which a fine ferrite phase is precipitated cannot be formed on the substrate steel side directly below the net structure scale layer.

The cooling is stopped at a temperature of 600° C. to 700° C. and the recuperation is performed to a temperature of 750° C. or higher and 800° C. or lower. After the recuperation, the slow cooling is performed to a temperature of 700° C. or lower at an average cooling rate of 3 to 20° C./h. Consequently, a ferrite dominant layer in which a fine ferrite phase is precipitated can be formed on the substrate steel side directly below the net structure scale layer. When the second-stage heat treatment includes a cycle of rapid cooling to a predetermined temperature range, recuperation, and then slow cooling as described above, the metal microstructure below the interface between the net structure scale layer and the substrate steel can contain many precipitated fine ferrite grains.

A heat treatment in which the substrate steel is heated and held at a temperature of 900° C. to 1000° C. and then primary cooling and secondary cooling are performed may be employed instead of the above-described second-stage heat treatment. The primary cooling includes first cooling in which the substrate steel is cooled to a temperature range of 850° C. to 800° C. at a cooling rate of 20 to 200° C./h and second cooling in which, after the first cooling, the substrate steel is cooled to 700° C. at a cooling rate of 3 to 20° C./h such that the difference in cooling rate between the first cooling and the second cooling is 10° C./h or more. In the secondary cooling, the substrate steel is cooled to 400° C. or lower at a cooling rate of 100° C./h or more. FIG. 2(*c*) schematically shows this second-stage heat cycle pattern.

This second-stage heat treatment is characterized by combining the first rapid cooling and second slow cooling in the primary cooling. If the cooling (first cooling) in a high temperature range is slow cooling performed at a cooling rate of less than 20° C./h, ferrite is excessively precipitated on the substrate steel side and grown into coarse grains during the cooling. Consequently, a desired microstructure on the substrate steel side cannot be provided. Only when the cooling (first cooling) in a high temperature range is rapid cooling and cooling (second cooling) in a low temperature range is slow cooling performed at a cooling rate of 20° C./h or less, fine ferrite grains are precipitated and a desired microstructure on the substrate steel side can be provided.

When such a heat treatment is performed, a net structure scale layer having a thickness of 10 to 200 μm in the depth direction is formed in the scale layer at the boundary with the substrate steel, and furthermore a microstructure on the substrate steel side in a range of at least 300 μm in the depth direction from the interface between the net structure scale layer and the substrate steel includes a ferrite dominant layer in which 400/mm$^2$ or more of fine ferrite grains having a maximum grain length of 1 to 60 μm are contained. It is advantageous that the difference in cooling rate between the first cooling and the second cooling is 10° C./h or more because many fine ferrite grains are precipitated.

The tool for a piercing mill subjected to the above heat treatment is used in piercing a plurality of times and contributes to the production of seamless pipes. When the tool for a piercing mill is used in piercing, the scale layer formed on the surface is worn away. By forming a scale layer again before erosion, seizing, and formation of cavities occur, the tool for a piercing mill can be reused. The heat treatment for forming a scale layer again is desirably the same as the two-stage heat treatment because this advantageously contributes to an increase in the lifetime of the tool for a piercing mill.

In any of the heat treatments, rapid cooling is preferably performed at a temperature of 500° C. or lower from the viewpoint of preventing the degradation of lubrication ability caused by the change of the scale layer into hematite. If possible, air cooling outside a furnace or air-blast cooling outside a furnace is preferred.

EXAMPLES

Figure 3:
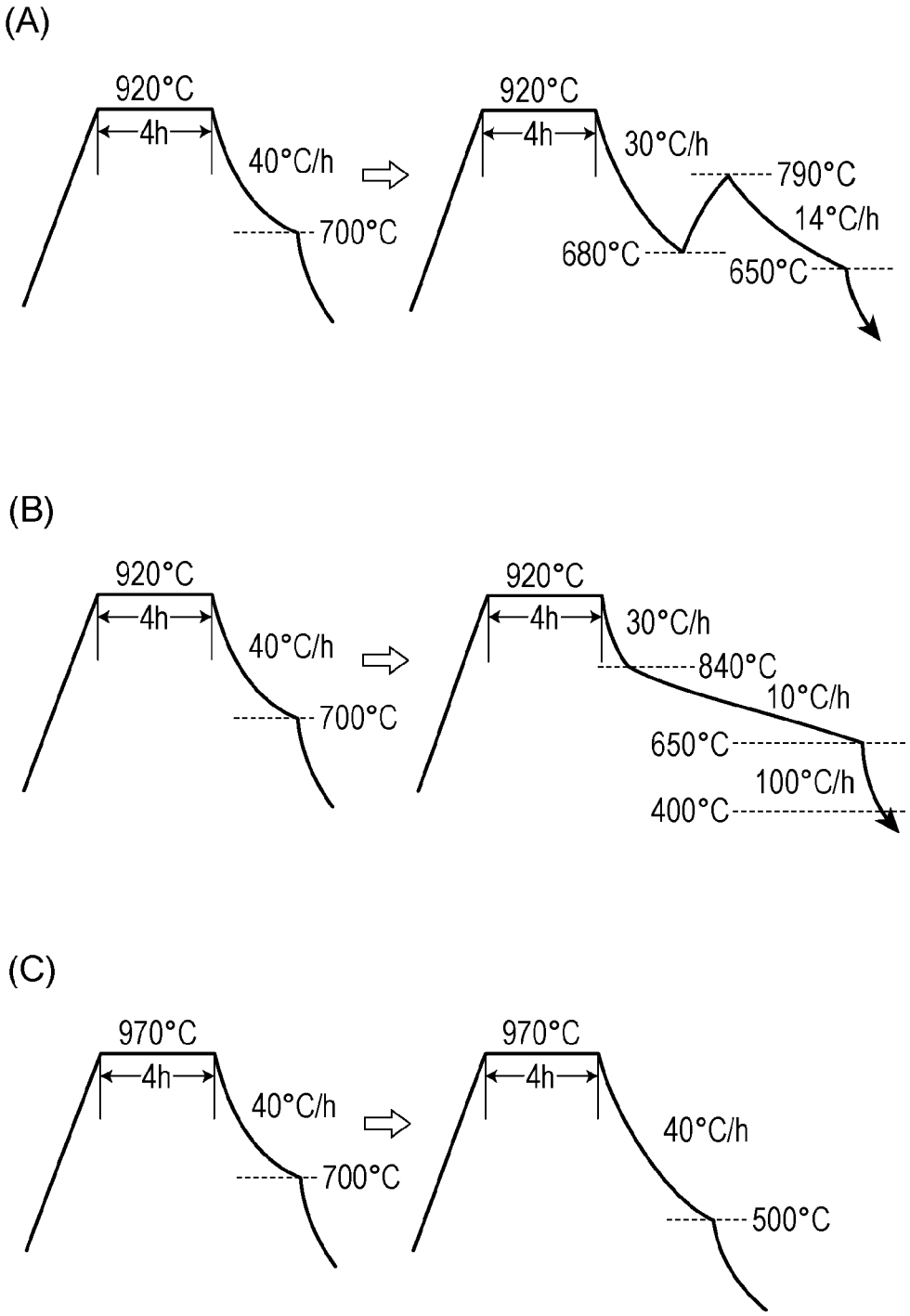
FIGS. 3(A) to 3(C) are explanatory views schematically showing heat treatment patterns used in Examples.

A molten steel having the composition shown in Table 1 was melted in a high-frequency furnace with an air atmosphere and cast by a V process (vacuum sealed molding, process) to obtain a piercer plug having a maximum outer diameter of 174 mmϕ. The obtained piercer plug was used as a substrate steel. The substrate steel was subjected to a heat treatment (A), (B), or (C) shown in FIG. 3 to obtain a tool for a piercing mill that includes a scale layer and a microstructure on the substrate steel side below the interface. Table 2 shows the obtained tool for a piercing mill. The tool for a piercing mill was used in piercing.

The heat treatment (A) included a first-stage heat treatment and a second-stage heat treatment. In the first-stage heat treatment, the substrate steel was held at a heating temperature of 920° C. for 4 hours and then cooled t 700° C. at a cooling rate of 40° C./h. In the second-stage heat treatment, the substrate steel was held at a heating temperature of 920° C. for 4 hours; a furnace cover was opened and the substrate steel was rapidly cooled (30° C./h) until the temperature in a central portion of the furnace (temperature in an atmosphere) reached 680° C.; the furnace cover was closed and the substrate steel was recuperated until the temperature in a central portion of the furnace (temperature in an atmosphere) reached 790° C.; and the substrate steel was slowly cooled to 650° C. at an average cooling rate of 14° C./h.

The heat treatment (B) included a first-stage heat treatment and a second-stage heat treatment. In the first-stage heat treatment, the substrate steel was held at a heating temperature of 920° C. for 4 hours and then cooled to 700° C. at a cooling rate of 40° C./h. In the second-stage heat treatment, the substrate steel was held at a heating temperature of 920° C. for 4 hours and then primary cooling and secondary cooling were performed. The primary cooling included first cooling in which the substrate steel was cooled at an average cooling rate of 30° C./h until the temperature in a central portion of the furnace (temperature in an atmosphere) reached 840° C. and second cooling in which the substrate steel was cooled to 650° C. at an average cooling rate of 10° C./h. In the secondary cooling, the substrate steel was cooled to 400° C. or lower at an average cooling rate of 100° C./h.

The heat treatment (C) was a known heat treatment including a first-stage heat treatment in which the substrate steel was held at a heating temperature of 970° C. for 4 hours and then cooled to 700° C. at an average cooling rate of 40° C./h and a second-stage heat treatment in which the substrate steel was held at a heating temperature of 970° C. for 4 hours and then cooled to 500° C. at an average cooling rate of 40° C./h.

After the heat treatment, the cross-sectional microstructure of the plug was subjected to a nital corrosion treatment and observed with an optical microscope (magnification: 200 times) to measure the thickness of a net structure scale layer in the depth direction. A scale layer containing a metal at an area fraction of 10% to 80% was treated as the net structure scale layer.

The microstructure on the substrate steel side below the interface between the net structure scale layer and the substrate steel was similarly observed in order to measure the area fraction of a ferrite phase. The thickness of a ferrite dominant layer containing a ferrite phase at an area fraction of 50% or more was measured. Since the interface of the ferrite phase has irregularities, the thickness of the ferrite dominant layer was determined by measuring ten maximum thicknesses and ten minimum thicknesses and averaging the thicknesses. The thickness of the ferrite dominant layer was collectively expressed in units of 50 μm. In addition, ferrite grains in the ferrite phase were each observed in order to measure the maximum length and the number of ferrite grains having a maximum length of 10 μm or more and 60 μm or less was determined. This measurement was conducted in a 300 μm square region below the interface.

By performing the above-described heat treatment, a scale layer having a thickness of about 700 to 800 μm was formed in a surface layer of the substrate steel. Subsequently, the piercer plug including the scale layer formed in the surface layer thereof was used in the piercing of 13Cr steel billets (outer diameter 207 mm×length 1800 mm, billet temperature 1050° C. to 1150° C.). The surface of the plug was visually observed each time two billets underwent piercing. In the case where erosion, seizing, and formation of cavities did not occur on the plug when four billets in total underwent piercing, the heat treatment shown in FIG. 3(A), 3(B), or 3(C) was performed to further reuse the plug. Thus, the plug was repeatedly used. The cumulative number of billets pierced until the erosion, seizing, and formation of cavities occurred on the plug surface was defined as the lifetime of the plug. Three plugs having the same conditions were prepared, and the average of the cumulative numbers of billets pierced by the three plugs was defined as the lifetime of the plug. The average was rounded off to an integer.

Table 2 shows the results.

TABLE 1

| Steel | Chemical composition (mass %) | | | | | | | | | | | | | |
|---|---|---|---|---|---|---|---|---|---|---|---|---|---|---|
| No. | C | Si | Mn | Cr | Mo | W | Nb | Ni | Co | Ni + Co | Al | P | S | Remarks |
| A | 0.08 | 0.36 | 0.51 | 0.29 | 2.15 | 1.83 | 0.78 | 1.82 | 1.42 | 3.24 | 0.009 | 0.011 | 0.01 | Invention Example |
| B | 0.14 | 0.42 | 0.45 | 0.43 | 1.18 | 2.11 | 0.32 | 1.58 | 0.98 | 2.56 | 0.018 | 0.01 | 0.008 | Invention Example |
| C | 0.13 | 0.64 | 1.01 | 0.54 | 0.99 | 1.94 | 0.24 | 1.49 | 1.02 | 2.51 | 0.022 | 0.019 | 0.015 | Invention Example |
| D | 0.25 | 0.56 | 0.87 | 0.87 | 1.53 | 0.69 | 0.15 | 0.86 | 0.72 | 1.58 | 0.026 | 0.027 | 0.016 | Invention Example |
| E | 0.32 | 0.39 | 0.42 | 0.49 | 1.17 | 2.45 | 0.48 | 1.05 | 1.12 | 2.16 | 0.039 | 0.01 | 0.005 | Invention Example |
| F | 0.35 | 0.28 | 1.03 | 0.52 | 1.21 | 2.52 | 0.44 | 1.02 | 0.66 | 1.68 | 0.021 | 0.016 | 0.003 | Invention Example |
| G | 0.52 | 0.51 | 0.52 | 3.09 | 0.49 | — | — | 1.18 | — | 1.18 | 0.028 | 0.017 | 0.008 | Comparative Example |
| H | 0.33 | 0.5 | 0.71 | 2.76 | 0.42 | 3.1 | 0.53 | 1.08 | — | 1.08 | 0.021 | 0.016 | 0.009 | Comparative Example |
| I | 0.3 | 0.45 | 0.39 | 3.01 | 0.68 | 0.54 | — | 0.88 | 0.74 | 1.62 | 0.033 | 0.013 | 0.012 | Comparative Example |
| J | 0.28 | 0.56 | 1.92 | 0.41 | 2.18 | 3.72 | 0.45 | 0.41 | 3.82 | 4.23 | 0.021 | 0.02 | 0.004 | Comparative Example |
| K | 0.26 | 0.49 | 0.47 | 0.56 | 1.05 | 3.23 | — | 0.91 | — | 0.91 | 0.028 | 0.018 | 0.006 | Comparative Example |
| L | 0.59 | 0.48 | 0.87 | 0.52 | 0.64 | 1.48 | 0.52 | 3.45 | 0.53 | 3.98 | 0.031 | 0.019 | 0.008 | Comparative Example |
| M | 0.27 | 0.51 | 0.48 | 0.52 | 1.02 | 2.02 | 0.19 | 1.28 | 1.01 | 2.29 | — | 0.008 | 0.004 | Invention Example |

Underlined part: outside the scope of the present invention

TABLE 2

| | | Heat | Net structure scale layer | Microstructure on substrate steel side below interface | | Plug lifetime | |
|---|---|---|---|---|---|---|---|
| Tool No. | Steel No. | treatment Pattern | Thickness in depth direction (μm) | Thickness of ferrite precipitation layer (μm)* | Number of fine ferrite grains (/mm$^2$)** | Number of billets | Remarks |
| 1 | A | A | 90 | >300 | >560 | 14 | Invention Example |
| 2 | B | B | 100 | >300 | >560 | 18 | Invention Example |
| 3 | B | A | 120 | >300 | >560 | 17 | Invention Example |
| 4 | C | A | 100 | >300 | >560 | 19 | Invention Example |
| 5 | D | B | 110 | >300 | >560 | 14 | Invention Example |
| 6 | D | A | 160 | >300 | >560 | 17 | Invention Example |
| 7 | D | C | 60 | >300 | 322 | 7 | Comparative Example |
| 8 | E | A | 110 | >300 | >560 | 18 | Invention Example |
| 9 | F | A | 90 | >300 | >560 | 17 | Invention Example |
| 10 | G | C | 10 | >300 | 55 | 2 | Comparative Example |
| 11 | G | A | 20 | 200 | 78 | 4 | Comparative Example |
| 12 | H | A | 10 | >300 | 144 | 4 | Comparative Example |
| 13 | I | A | 10 | 200 | 144 | 4 | Comparative Example |
| 14 | J | A | 20 | >300 | 155 | 4 | Comparative Example |
| 15 | J | C | 60 | >300 | 188 | 4 | Comparative Example |
| 16 | J | A | 110 | >300 | 366 | 8 | Comparative Example |
| 17 | K | A | 10 | >300 | 155 | 4 | Comparative Example |
| 18 | L | A | 110 | 250 | 355 | 6 | Comparative Example |
| 19 | M | B | 120 | >300 | >560 | 15 | Invention Example |

Underlined part: outside the scope of the present invention

*Thickness of a region in which a ferrite phase accounts for 50% or more

**Number of ferrite grains having a maximum grain length of 1 to 60 μm

In each of Invention Examples, a net structure scale layer having a desired thickness was formed on the substrate steel side of the scale layer formed on the surface. Furthermore, a ferrite phase containing many fine ferrite grains was formed on the substrate steel side directly below the interface with the net structure scale layer. Consequently, the plug lifetime was considerably longer than those in Comparative Examples. In contrast, in Comparative Examples in which the composition was outside the scope of the present invention, the thickness of the net structure scale layer was small or the number of fine ferrite grains was small even if the scale-forming treatment was within the scope of the present invention. Consequently, a long plug lifetime was not achieved.

The invention claimed is:

1. A tool for a piercing mill, the tool comprising a scale layer in a surface layer of a substrate steel, wherein the substrate steel has a composition containing, on a mass % basis:

C: 0.05% to 0.5%,
Si: 0.1% to 1.5%,
Mn: 0.1% to 1.5%,
Cr: 0.1% to 1.5%,
Mo: 0.6% to 3.5%,
W: 0.5% to 3.5%, and
Nb: 0.1% to 1.0%, and further containing Co: 0.5% to 3.5% and Ni: 0.5% to 4.0% so as to satisfy formula (1) below, with the balance being Fe and incidental impurities;

wherein the scale layer includes a net structure scale layer that is formed on a substrate steel side, has a thickness of 10 to 200 μm in a depth direction, and is complicatedly intertwined with a metal; and wherein a microstructure on the substrate steel side in a range of at least 300 μm in the depth direction from an interface between the net structure scale layer and the substrate steel contains a ferrite phase at an area fraction of 50% or more, the ferrite phase containing 400/mm$^2$ or more of ferrite grains having a maximum length of 1 to 60 μm, $$1.0<Ni+Co<4.0 \quad (1)$$

where Ni represents a content (mass %) of nickel and Co represents a content (mass %) of cobalt.

2. A tool for a piercing mill, the tool comprising a scale layer in a surface layer of a substrate steel, wherein the substrate steel has a composition containing, on a mass % basis:

C: 0.05% to 0.5%,
Si: 0.1% to 1.5%,
Mn: 0.1% to 1.5%,
Cr: 0.1% to 1.5%,
Mo: 0.6% to 3.5%,
W: 0.5% to 3.5%,
Nb: 0.1% to 1.0%, and
Al: 0.05% or less, and further containing Co: 0.5% to 3.5% and Ni: 0.5% to 4.0% so as to satisfy formula (1) below, with the balance being Fe and incidental impurities;

wherein the scale layer includes a net structure scale layer that is formed on a substrate steel side, has a thickness of 10 to 200 μm in a depth direction, and is complicatedly intertwined with a metal; and wherein a microstructure on the substrate steel side in a range of at least 300 μm in the depth direction from an interface between the net structure scale layer and the substrate steel contains a ferrite phase at an area fraction of 50% or more, the ferrite phase containing 400/mm$^2$ or more of ferrite grains having a maximum length of 1 to 60 μm, $$1.0<Ni+Co<4.0 \quad (1)$$

where Ni represents a content (mass %) of nickel and Co represents a content (mass %) of cobalt.

* * * * *